US006303861B1

(12) United States Patent
Dobrinski et al.

(10) Patent No.: US 6,303,861 B1
(45) Date of Patent: Oct. 16, 2001

(54) CONNECTOR FOR CONNECTING A CONDUCTOR TO A STRUCTURAL MEMBER

(75) Inventors: Daniel David Dobrinski, Raymond; Keith Francis Mello, Manchester, both of NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/422,506

(22) Filed: Oct. 21, 1999

(51) Int. Cl.[7] ..... H01B 13/00

(52) U.S. Cl. ..... 174/55 G; 174/94 R; 29/873; 403/271; 403/391; 439/880; D13/149

(58) Field of Search ..... 174/55 G, 6, 7, 174/71 R, 84 C, 94 R, 90; 439/92, 94, 95, 880; 24/194; 29/871, 872, 873, 513; D13/149; 403/278, 271, 285, 385, 391

(56) References Cited

U.S. PATENT DOCUMENTS

| | | | | |
|---|---|---|---|---|
| 3,183,025 | * | 5/1965 | Lynch, Jr. et al. | 403/390 |
| 3,354,517 | * | 11/1967 | Levinsky | 403/275 |
| 4,350,843 | * | 9/1982 | Campbell et al. | 174/94 R |
| 5,036,164 | | 7/1991 | Schrader et al. | 174/94 R |
| 5,103,068 | * | 4/1992 | Schrader | 174/94 R |
| 5,240,423 | | 8/1993 | Morrison | 439/92 |
| 5,552,564 | | 9/1996 | Schrader et al. | 174/84 C |

FOREIGN PATENT DOCUMENTS

| | | | | |
|---|---|---|---|---|
| 499141-A2 | * | 8/1992 | (EP) | 174/94 R |

* cited by examiner

*Primary Examiner*—Dean A. Reichard
*Assistant Examiner*—Adolfo Nino
(74) *Attorney, Agent, or Firm*—Perman & Green, LLP

(57) ABSTRACT

A grounding connector includes a frame with upper and lower arms cantilevered from a center section to form a channel adapted to receive a section of a structural steel member. The frame has a conductor receiving region in each of the cantilevered arms, each conductor receiving region being a slot extending through the frame having a longitudinal axis aligned substantially parallel to the frame. The conductor receiving slot on one side of the frame is sized to receive a conductor of a first size and the conductor receiving slot on the other side is sized to receive a conductor of a different size. The conductor receiving regions are located so that when the upper arm and the lower arm are compressed to grip the section of the structural steel member received in the channel, the conductor is crimped to the frame. In another embodiment, the upper and lower arms of the frame have opposed surfaces for engaging the flange of the structural member and at least one of the opposed surfaces has an elongated protrusion such that when the frame is caused to clasp the flange of the structural member, the protrusion provides a slight interference between the width of the U-shaped frame and the thickness of the flange of the structural member. In other instances, opposed elongated protrusions are substantially coplanar and may be aligned substantially parallel to the frame or substantially transverse of the frame.

16 Claims, 5 Drawing Sheets

CONNECTOR FOR CONNECTING A CONDUCTOR TO A STRUCTURAL MEMBER

BACKGROUND OF THE INVENTION

1. Field of the Invention

The present invention relates to a connector and, more particularly, to a connector for crimping a conductor to a structural member and, still more particularly, to a connector for crimping multiple conductors of different sizes to a structural member.

2. Prior Art

Compression connectors are generally well known in the art. One example is U.S. Pat. No. 5,036,164 to Schrader et al. which discloses a compression ground connector for connecting one or more taps from a single connector to an installation requiring grounding. Another example is U.S. Pat. No. 5,240,423 to Morrison which discloses a grounding connector capable of being clamped to a tapered metallic flange of an I-beam. Still another example is U.S. Pat. No. 5,552,564 to Schrader et al. which discloses an H-shaped compressible connector having a main body and two pairs of opposed legs extending in opposite directions from the main body. The H-shaped connector is designed to require a relatively small amount of compressive force to be applied to a crimping device to completely close the connector and into connective engagement with conductors.

It was with knowledge of the foregoing that the present invention was conceived and has now been reduced to practice.

SUMMARY OF THE INVENTION

The present invention relates to a grounding connector which includes a frame with upper and lower arms cantilevered from a center section to form a channel adapted to receive a section of a structural steel member. The frame has a conductor receiving region in each of the cantilevered arms, each conductor receiving region being a slot extending through the frame having a longitudinal axis aligned substantially parallel to the frame. The conductor receiving slot on one side of the frame is sized to receive a conductor of a first size and the conductor receiving slot on the other side is sized to receive a conductor of a different size. The conductor receiving regions are located so that when the upper arm and the lower arm are compressed to grip the section of the structural steel member received in the channel, the conductor is crimped to the frame. In another embodiment, the upper and lower arms of the frame have opposed surfaces for engaging the flange of the structural member and at least one of the opposed surfaces has an elongated protrusion such that when the frame is caused to clasp the flange of the structural member, the protrusion provides a slight interference between the width of the U-shaped frame and the thickness of the flange of the structural member. In other instances, opposed elongated protrusions are substantially coplanar and may be aligned substantially parallel to the frame or substantially transverse of the frame.

The invention allows for the attachment of a conductor to a structural steel member by inserting the conductor into a conductor hole in the leg of the connector and placing the connector onto the structural member. The connector is then compressed onto the structural member. During the compression process, the conductor hole is deformed around the conductor thus securing it in place. One key to the present invention is that the conductor hole diameter is slightly larger than the diameter of the conductor, large enough so the conductor is readily received into the hole but not so large it subsequently deforms around the conductor in an inadequate manner. Another key to the present invention is that, previously, all conductor holes in the structural member were sized for one size conductor only whereas the present invention accommodates various sizes of conductors.

Indeed, it can be stated that there are three features embodied by the present invention which improve upon the prior art. These improved characteristics can be described as follows.

In a first instance, the novel connector is formed with one conductor hole which can accept, for example, either a #2 AWG solid conductor (0.257" dia.) or a #2 AWG stranded conductor (0.320" dia.) while the other conductor hole can accept either a #6 AWG solid conductor (0.162" dia.) or a #6 AWG stranded conductor (0.184" dia.). This is accomplished through the use of two protrusions that are parallel to the front surface of the connector that extend outwardly above the conductor holes. During the compression process, the dies of the compression tool interface with these protrusions first. A concentrated force is produced which collapses the material of the protrusions into any voids of the conductor hole not occupied by the conductor itself. During the remainder of the crimp process, this material, along with other material around the conductor being securely attached to the connector and the connector/conductor assembly being securely fastened to the structural member.

In a second instance, the situation is addressed that when installing structural compression connectors, it is desirable for the connector to have the ability to be placed on the structural member and remain temporarily "tacked" in position before being permanently compressed onto the member. This offers the installer the ability to position the conductors into the connector using both hands instead of holding the connector in place with one hand and positioning the conductor with the other. This construction also holds the connector in place while the installer orientates the tool over the connector/conductor assembly and compresses the assembly in place for permanent attachment. This desirable result is accomplished by the invention. In the groove of the connector that accepts the structural member, a protrusion is provided on both the top and bottom surfaces of the groove. This groove may have several different orientations. These protrusions provide a slight interference between the width of the connector groove and the thickness of the structural member when the connector is placed onto the structural member. Because of the interference fit, the connector may need to be tapped onto the member with the use of a hammer or the like. In this manner, the connector of the invention is temporarily retained in engagement with the structural member before permanent attachment occurs.

In a third instance, the connector of the invention offers the ability of accepting a continuous run conductor and/or a tap conductor. To this end, the continuous run hole of a known connector design has been modified to a U-shaped conductor hole to accommodate a continuous run.

A primary feature, then, of the present invention is the provision of a connector for crimping a conductor to a structural member.

Another feature of the present invention is the provision of such a connector capable of crimping multiple conductors of different sizes to a structural member.

Still another feature of the present invention is the provision of such a connector being a grounding connector having a frame adapted for clamping to a flange of a structural member, the frame having a general U-shape with an upper arm and a lower arm cantilevered from a center section to form opposite sides of the U-shaped frame, the opposite sides of the U-shaped frame being adapted to clasp therebetween the flange of the structural member when the U-shaped frame is clamped to the flange, the U-shaped frame having a pair of conductor receiving regions, each to receive a conductor therein, the conductor receiving regions being located, respectively, in the opposite sides of the U-shaped frame so that when the opposite sides of the U-shaped frame are deformed to clasp the flange of the structural member the conductors located in the conductor receiving regions are crimped to the U-shaped frame.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figures 1, 2, 3:
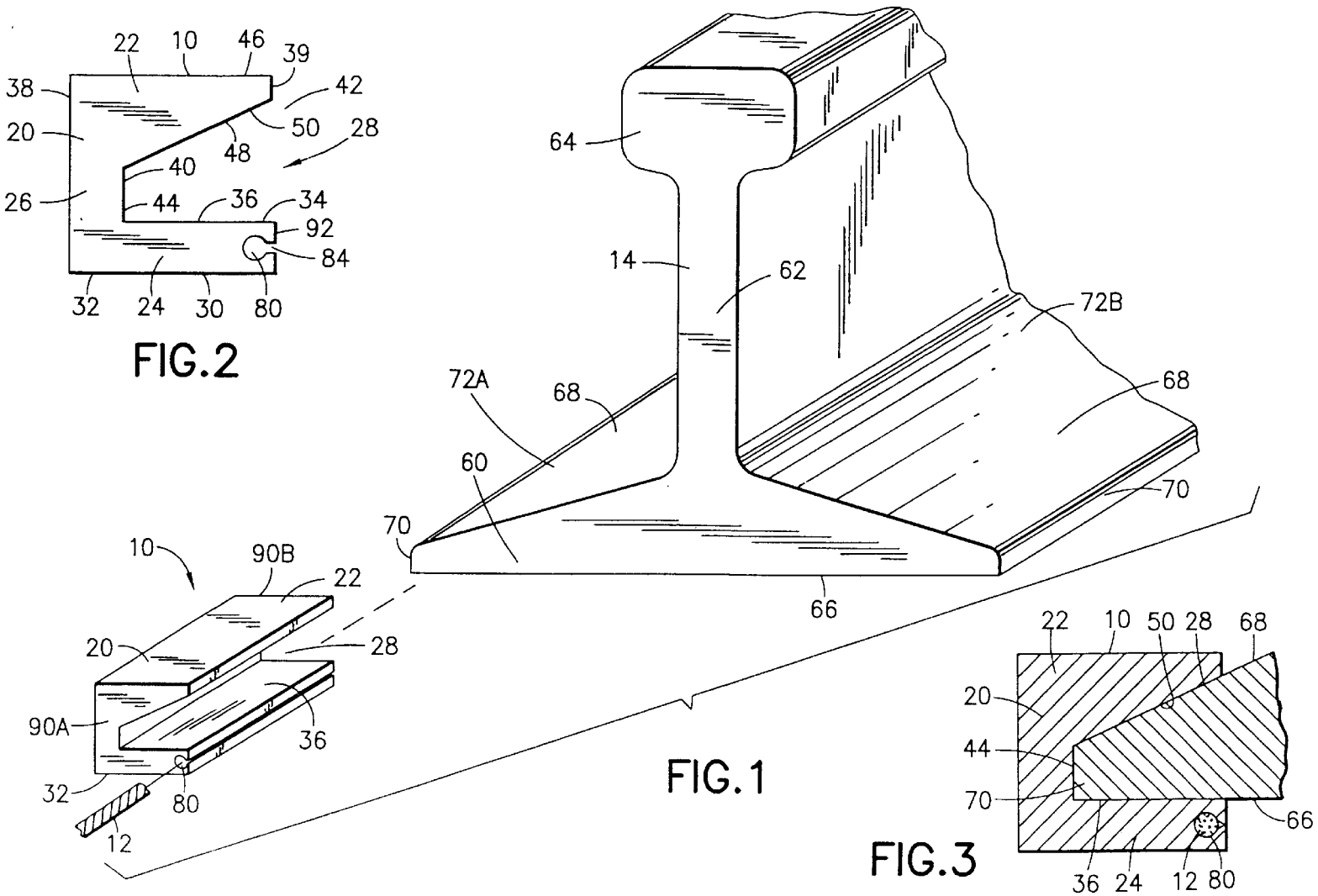
FIG. 1 is an exploded perspective view of a known connector for attaching a conductor to a portion of a railroad rail.
FIG. 2 is an elevational side view of the connector shown in FIG. 1.
FIG. 3 is a cross-sectional view of the connector shown in FIG. 1 attaching the conductor to the railroad rail.

Referring to FIG. 1, there is shown an exploded perspective view of a known connector 10 which is improved by the present invention in a manner to be described below. The known connector 10 is used to mechanically and electrically connect a grounding conductor 12 to a railroad rail member 14 or other structural member. The conductor 12 is inserted into the connector 10 and the connector 10 is then crimped or compressed onto a portion of the railroad rail member 14. The connector 10 is thus mechanically held to the railroad rail member 14. This mechanical connection also electrically connects the connector 10 to the railroad rail member 14. When the connector 10 is crimped to the rail member 14, the conductor 12 is crimped to the connector 10. This operation mechanically and electrically connects the conductor 12 to the connector 10. Thus, the conductor 12 is connected to the connector 10 and the connector 10 is connected to the railroad rail member 14 in one crimping stroke. Consequently, the conductor 12 is mechanically and electrically connected to the railroad rail member 14, by the connector 10. Preferably, the conductor 12 is grounded such that the rail 14 becomes grounded, and the rail member 14 is grounded by the conductor 12 with one crimping motion.

Referring also to FIG. 2, the connector 10 has a frame 20 made from a malleable electrically conducting metal. Preferably, the frame 20 is a one-piece member. The frame 20 has an upper arm 22 and a lower arm 24 cantilevered from a central web section 26 to form a generally "U"-shaped channel 28. The lower arm 24 is substantially flat. The lower arm 24 has an external surface 30 forming a seating surface 32 of the connector 10. The inner surface 34 of the lower arm 24 forms a lower side 36 of the channel 28. The web 26 extends between the upper arm 22 and lower arm 24 at a rear end 38 of the frame 20. The web 26 is substantially perpendicular to the lower arm 24. The face 40 of the web 26 facing the opening 42 of the channel 28 is the bottom 44 of the channel 28. The upper arm 22 has a tapered cross-section. The outer surface 46 of the upper arm 22 is substantially flat and generally parallel with the seating surface 32 of the connector 10. The inner surface 48 of the upper arm 22 forms the upper side 50 of the channel 28. The upper side 50 slopes upwards from the bottom 44 of the channel 28 forward to the front end 39 of the frame 20. Hence, the channel 28 has a taper which narrows the channel 28 from its opening 42 to the bottom 44. The taper of the channel 28 in the connector 10 generally conforms to the taper of the foot flange 60 of the railroad rail member 14; a portion of which is received in the channel 28 (see FIG. 3). The railroad rail member 14 has a foot flange 60 supporting a center web 62 with a rail head 64. The foot flange 60 has a substantially flat lower seating surface 66. The upper surfaces 68 of the foot flange 60 slope downward from the web 62 to the toes 70 of the foot flange 60. The slope of the upper surfaces 68 of the foot flange 60 conform to the slope of the upper side 50 of the channel 28 in the connector 10.

Still referring to FIGS. 1 and 2, the connector has a slot 80 for receiving the conductor 12 therein. In one embodiment, the slot 80 is a through slot extending from one side 90A of the connector 10 to the other side 90B. In alternate embodiments, the connector receiving slot in the connector may be a partial slot. The slot 80 is located in the lower arm 24 of the connector 10, proximate a front face 92 of the lower arm 24 (see FIG. 2). In the one embodiment, the slot 80 has a generally "C"-shaped cross-section adapted to admit the conductor 12 therein. The front face 92 of the lower arm 24 has an opening 84 therein communicating with the "C"-shaped cross-section of the slot 80. The opening 84 is sized to exclude the conductor 12 but render the slot 80 sufficiently deformable to crimp the conductor 12 therein, without overly crushing the conductor 12, under compression applied to the external surface 30 and inner surface 34 of the lower arm 24. In alternate embodiments, the conductor receiving slot may have any other suitable shape providing a deformable slot for crimping the conductor therein or be located at another position or orientation on the frame.

Referring also to FIG. 3, the railroad rail member 14 is grounded by connecting the connector 10, with the conductor 12 at least partially attached thereto, to the foot flange 60 of the railroad rail member 14. The connector 10 may be attached to either side 72A, B of the foot flange 60. The connector 10 is connected to the railroad rail member 14 by inserting frame 20 onto the toe 70 of the foot flange 60 with the toe 70 being received in the channel 28. Preferably, the foot flange 60 is received into the channel 28 until the toe 70 abuts the bottom 44 of the channel 28. In this position, the slope of the upper side 50 of the channel 28 preferably complements the taper of the foot flange 60 and the lower side 36 of the channel 28 is seated against the lower seating surface 66 of the foot flange 60. The conductor 12 is attached to the connector 1 by inserting the conductor into the slot 80. Once the conductor 12 is located in the slot 80 and the connector 10 is positioned on the foot flange 60, the connector 10 is crimped to the foot flange 60. Crimping is accomplished, preferably by a hydraulic or cartridge driven compression tool, by compressing the upper arm 22 and lower arm 24 inward or towards each other to engage the foot flange 60 inside the channel 28. The upper 22 and lower 24 arms are deformed with sufficient force to generate grip between the upper surface 68 and lower surface 66 of the foot flange 60 and the upper side 50 and lower side 36 of the channel 28 respectively. Hence, the connector 10 is mechanically connected to the railroad rail member 14. As noted above, prior to crimping the connector 10 on the rail member 14, the grounding conductor 12 is inserted into slot 80. The crimping stroke that attaches the connector to the rail 14 also effects electrical and mechanical connection between the connector 10 and the conductor 12. The bearing forces generated during the crimping stroke between the lower seating surface 66 of the foot flange 60 and the lower side 36 of the channel 28 deforms the slot 80 to crimp the conductor 12 therein. Under the bearing forces generated during crimping of the connector 10 onto the foot flange 60, the opening 84 of the "C"-shaped slot 80 in the front face 92 of the lower arm 24 is closed. When the slot 80 is closed, the conductor 12 is clamped within the connector 10. Hence, the conductor 12 is mechanically and electrically connected to the connector 10. Consequently, crimping the connector 10 to the foot flange 60 of the railroad rail member 14 establishes both the mechanical and electrical connection between the connector 10 and rail member 14 and the mechanical and electrical connection between the conductor 12 and connector 10. Thus, the conductor 12 is electrically connected to the rail member 14, thereby grounding the rail member 14 to the conductor 12, with only one crimping stroke.

Figure 4:
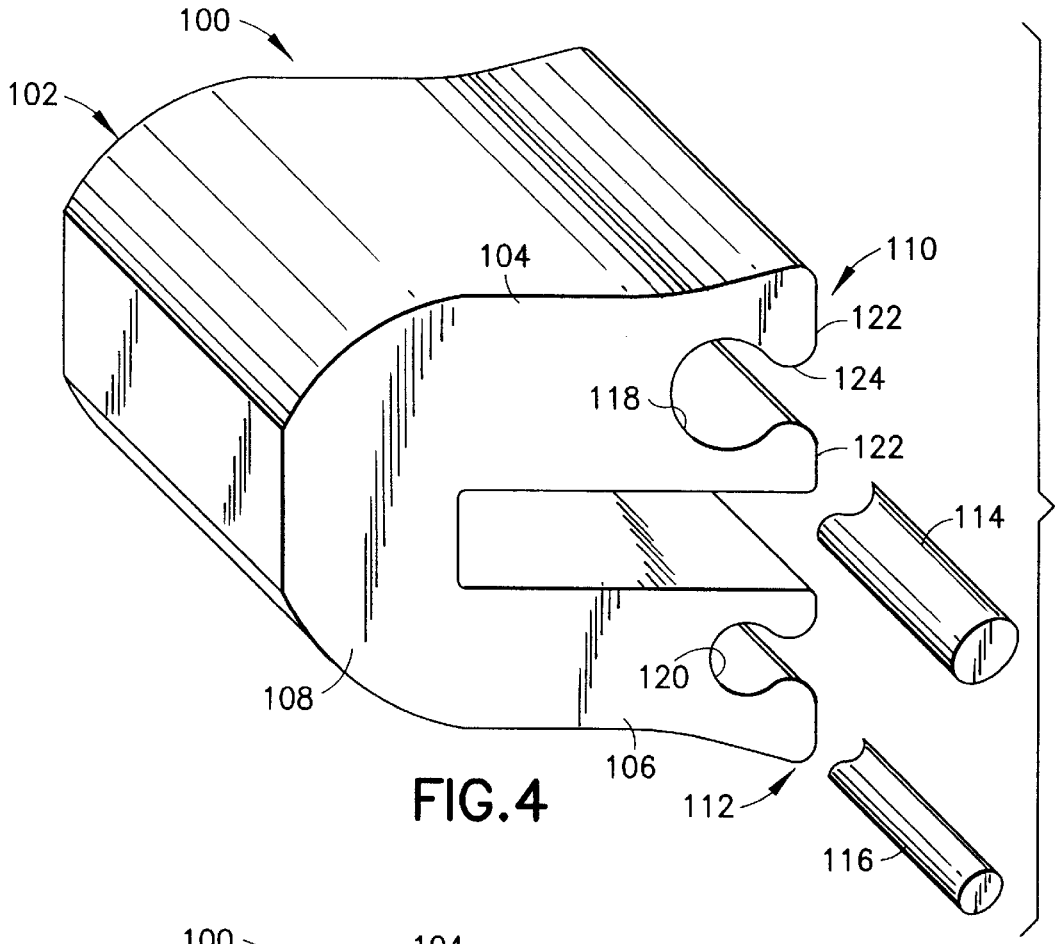
FIG. 4 is perspective view of a connector embodying certain features of the present invention.
Figure 5:
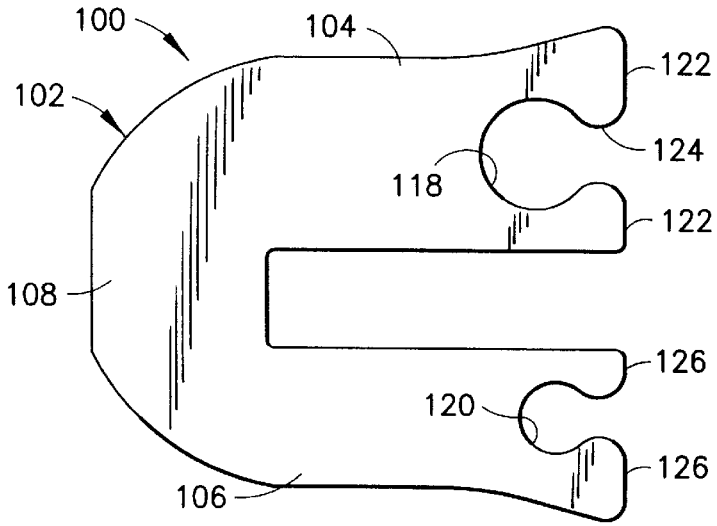
FIG. 5 is a side elevational view of the connector illustrated in FIG. 4.

Turn now to FIGS. 4 and 5 for a description of a first embodiment of the invention. Although the present invention will be described with reference to the embodiment illustrated in the drawings, it should be understood that the present invention can be embodied in many alternate forms of embodiments. In addition, any suitable size, shape or type of elements or materials could be used.

Figure 6:
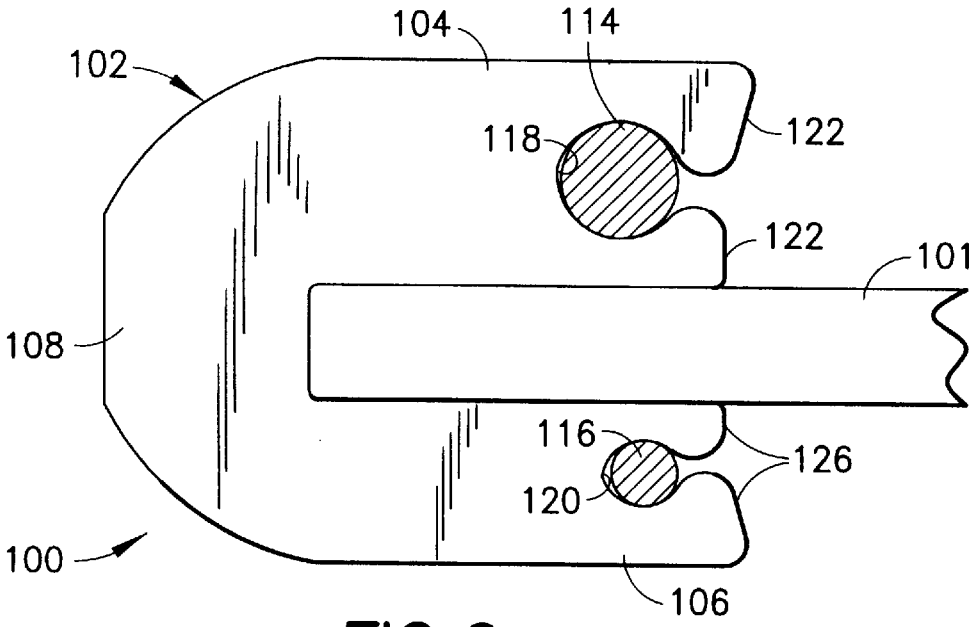
FIG. 6 is a side elevational view of the connector illustrated in FIG. 4 and 5 in its operational configuration after it has been attached to a structural member and connected to different-sized conductors.

As seen in FIGS. 4, 5, and 6, a grounding connector 100 has a frame 102 adapted for clamping to a flange 101 of a structural member which may be of uniform thickness as illustrated or tapered such as the rail member 14. The frame 102 has a general U-shape with an upper arm 104 and a lower arm 106. Both arms 104, 106 are cantilevered from a center section 108 to form opposite sides of the U-shaped frame. The opposite sides, or upper arm 104 and lower arm 106, of the U-shaped frame 102 are adapted to clasp between them the flange of the structural member.

The U-shaped frame 102 has a pair of conductor receiving regions, 110, 112, respectively, each for engageably receiving an associated conductor 114, 116. The conductor receiving regions are located, respectively, in the opposite sides of the U-shaped frame 102 so that when the opposite sides of the U-shaped frame, that is, the upper and lower arms 104, 106 are deformed to clasp the flange of the structural member, the conductors located in their associated conductor receiving regions are crimped to the U-shaped frame. As mentioned earlier, one positive feature of the present invention is that the conductor receiving region on one side of the U-shaped frame is sized differently than the conductor receiving region on the other side of the U-shaped frame. More specifically, the conductor receiving region 110 is a slot 118 having a generally "C"-shaped cross section extending through the U-shaped frame 102 having a longitudinal axis aligned substantially parallel to the U-shaped frame. Similarly, the conductor receiving region 112 is a slot 120 having a generally "C"-shaped cross section extending through the U-shaped frame 102 having a longitudinal axis aligned substantially parallel to the U-shaped frame. The slot 118 is sized to receive a conductor 114 of one size while the slot 120 is sized to receive a conductor 116 of a different size. As illustrated, the conductor 114 is of a larger gauge than the conductor 116.

With continuing reference to FIGS. 4 and 5, The upper arm 104 is seen to extend to a front face 122 and has a continuously extending opening 124 enabling communication between the front face and the conductor receiving slot 118 while being sized to exclude the conductor 114 intended to be received in the slot. Hence, it will be appreciated that entry of the conductor 114 into the slot 118 can only be achieved longitudinally and not laterally for reasons well known to those skilled in the art. In a similar fashion, the lower arm 106 extends to a front face 126 and has a continuously extending opening 128 enabling communication between the front face and the conductor receiving slot while being sized to exclude the conductor 116 intended to be received in the slot.

Figure 6A:
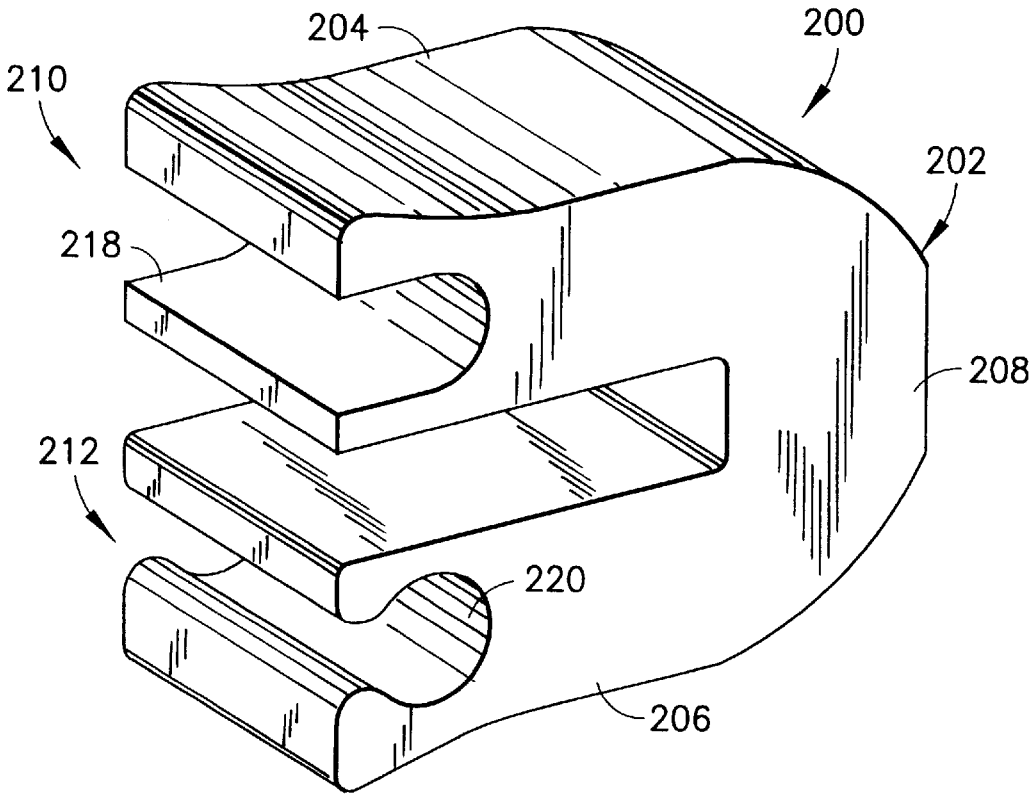
FIGS. 6A, 7, 8, and 9 are all perspective views of other embodiments of the connector of the present invention.

However, it must be understood that the invention is also applicable to other designs of connectors, for example, a grounding connector 200 as illustrated in FIG. 6A. As with the connector 100, the grounding connector 200 has a frame 202 adapted for clamping to the flange of a structural member and has a general U-shape with an upper arm 204 and a lower arm 206. Both arms 204, 206 are cantilevered from a center section 208 to form opposite sides of the U-shaped frame. The opposite sides, or upper arm 204 and lower arm 206, of the U-shaped frame 202 are adapted to clasp between them the flange of the structural member.

The U-shaped frame 202 has a pair of conductor receiving regions, 210, 212, respectively, each for engageably receiving an associated conductor. The conductor receiving regions are located, respectively, in the opposite sides of the U-shaped frame 202 so that when the opposite sides of the U-shaped frame, that is, the upper and lower arms 204, 206 are deformed to clasp the flange of the structural member, the conductors located in their associated conductor receiving regions are crimped to the U-shaped frame. Again, the conductor receiving region on one side of the U-shaped frame is sized differently than the conductor receiving region on the other side of the U-shaped frame. In this instance, the conductor receiving region 210 is a slot 218 having a generally "U"-shaped cross section while the conductor receiving region 212 is a slot 220 having a generally "C"-shaped cross section. As before, the slot 218 is sized to receive a conductor of one size while the slot 220 is sized to receive a conductor of a different size. Accordingly, the concept of the invention is applicable to grounding connectors whether the conductor receiving slots have a "U"-shaped or "C"-shaped cross section.

Figure 7:
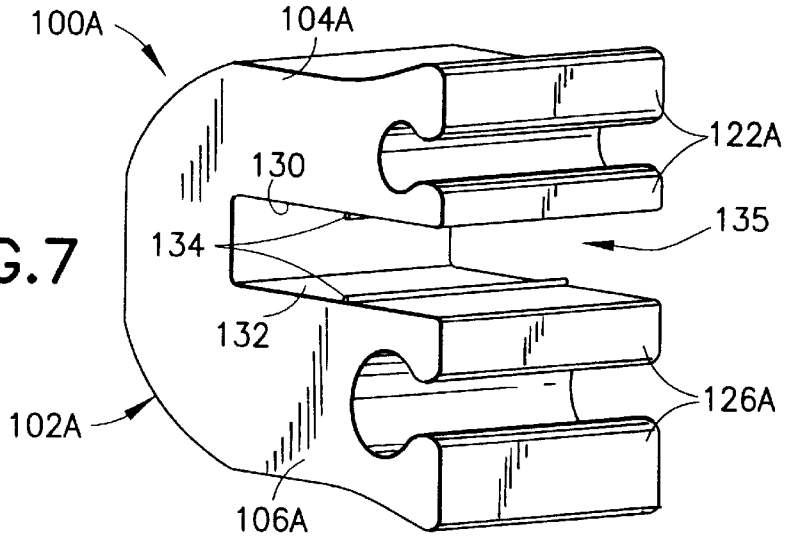
Figure 8:
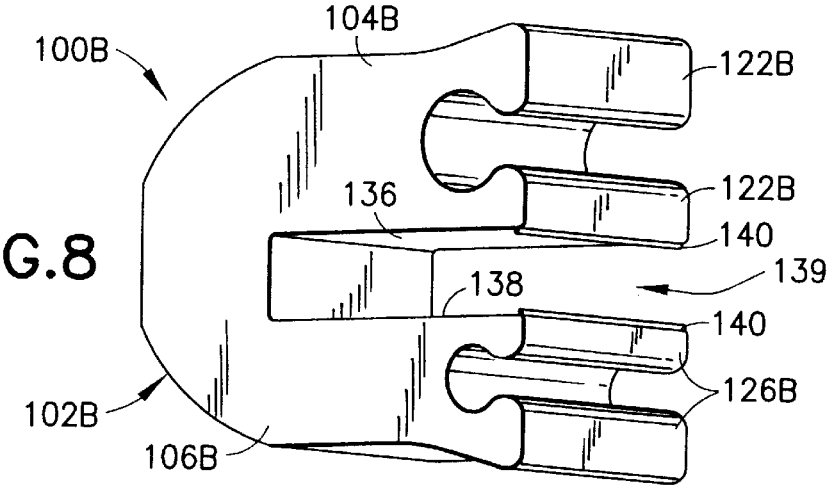
Figure 9:
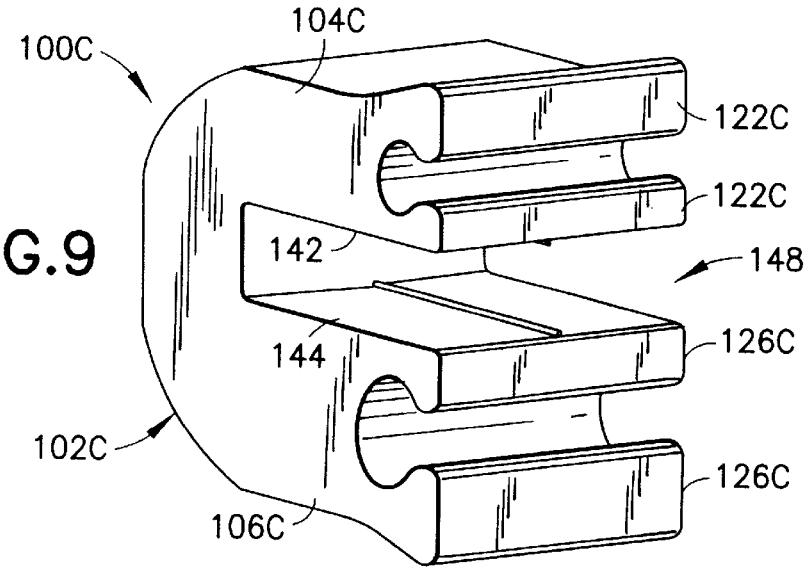

Turn now especially to FIGS. 7, 8, and 9 for the description of another embodiment of the invention. Generally as earlier described, upper and lower arms 104A, 106A, respectively, of frame 102A have opposed surfaces 130, 132 for engaging the flange of a structural member. At least one of the opposed surfaces 130, 132 has an elongated protrusion 134, although in FIG. 7, one is illustrated in each of the opposed surfaces. With such a construction, when the U-shaped frame 102A is caused to clasp the flange of the structural member received in a channel 135 at least partially defined by the opposed surfaces 130, 132, the protrusion or protrusions 134 provide(s) a slight interference between the width of the U-shaped frame and the thickness of the flange of the structural member. Although not critical to a preferred form of the invention, in FIG. 7, the protrusions 134 in the opposed surfaces 132 are illustrated as lying in a plane parallel to the plane of the faces 122A, 126A and aligned substantially parallel to the U-shaped frame.

In another instance as illustrated in FIG. 8, upper and lower arms 104B, 106B, respectively, of frame 102B have opposed surfaces 136, 138 for engaging the flange of the structural member. Again, at least one of the opposed surfaces 136, 138 has an elongated protrusion 140, although again in FIG. 8, one is illustrated in each of the opposed surfaces. Still again, with such a construction, when the U-shaped frame 102B is caused to clasp the flange of the structural member received in a channel 139 at least partially defined by the opposed surfaces 130, 132, the protrusion or protrusions 140 provide(s) a slight interference between the width of the U-shaped frame and the thickness of the flange of the structural member. Also, although not critical to a preferred form of the invention, in FIG. 8, the protrusions 140 in the opposed surfaces 136, 138 are illustrated as being aligned substantially parallel to the U-shaped frame 102B at the entrance to the channel 139, and are substantially coplanar.

In another instance as illustrated in FIG. 9, upper and lower arms 104C, 106C, respectively, of frame 102C have opposed surfaces 142, 144 for engaging the flange of the structural member. Yet again, at least one of the opposed surfaces 142, 144 has an elongated protrusion 146, although yet again in FIG. 9, one is illustrated in each of the opposed surfaces. Yet again, with such a construction, when the U-shaped frame 102C is caused to clasp the flange of the structural member received in a channel 148 at least partially defined by the opposed surfaces 142, 144, the protrusion or protrusions 140 provide(s) a slight interference between the width of the U-shaped frame and the thickness of the flange of the structural member. Also, although not critical to a preferred form of the invention, in FIG. 9, the protrusions 146 in the opposed surfaces 142, 144 are illustrated as being aligned substantially transverse of the U-shaped frame 102C at the entrance to the channel 148, and are substantially coplanar.

Figure 10:
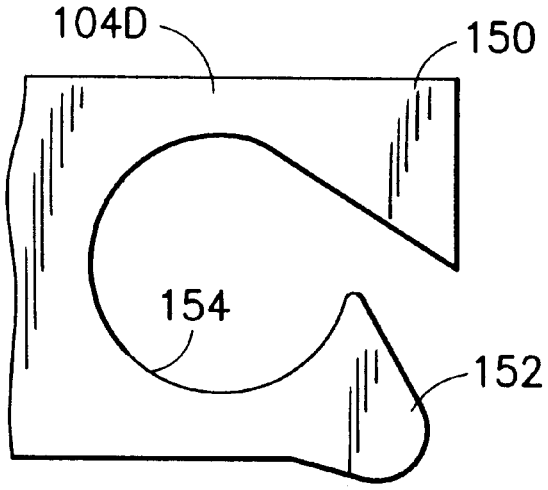
FIG. 10 is a detail side elevation view of a portion of another embodiment of the connector of the present invention in its beginning state.
Figure 11:
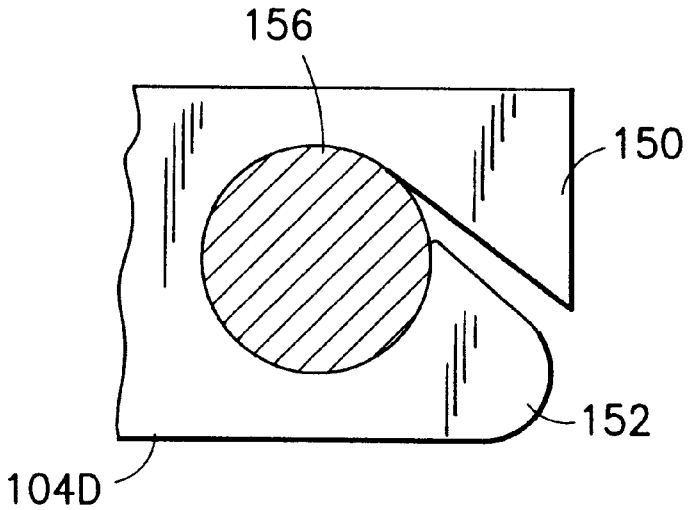
FIG. 11 is a detail side elevation view of the embodiment of the connector illustrated in FIG. 10 in its final state connected to a conductor.

Turning now to FIGS. 10 and 11, a modified upper arm 104D includes opposed first and second lip members 150, 152 generally encompassing a conductor receiving slot 154. The lip members 150, 152 are mutually configured such that when the opposite sides of the U-shaped frame are deformed to clasp the flange of the structural member, the second lip member 152 is rolled into the conductor receiving slot 154 beneath the first lip member 150 and into firm engagement with the conductor 156 received in the conductor receiving slot. As the operation continues, the first lip member 150 is rolled onto and into firm engagement with the second lip member 152 as seen in FIG. 11. Although not illustrated, for brevity, a similar operation occurs with respect to a similarly constructed modified lower arm with similar associated lip members and conductor receiving slot.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a grounding connector having a frame adapted for clamping to a flange of a structural member, the frame being generally U-shaped with an upper arm and a lower arm cantilevered from a center section to form opposite sides of the U-shaped frame, the opposite sides of the U-shaped frame being adapted to clasp therebetween the flange of the structural member when the U-shaped frame is clamped to the flange, wherein the improvement comprises:

the U-shaped frame having a pair of conductor receiving regions, each to receive a conductor therein, the conductor receiving regions being located, respectively, in the opposite sides of the U-shaped frame so that when the opposite sides of the U-shaped frame are deformed to clasp the flange of the structural member the conductors located in the conductor receiving regions are crimped to the U-shaped frame.

2. A grounding connector as in claim 1 wherein at least one of the upper arm and the lower arm includes opposed first and second lip members generally encompassing a conductor receiving slot, the lip members being mutually configured such that when the opposite sides of the U-shaped frame are deformed to clasp the flange of the structural member, the second lip member is rolled into the conductor receiving slot beneath the first lip member and engages the first lip member and is caused to move into firm engagement with the conductor received in the conductor receiving slot and into firm engagement with the second lip member.

3. A grounding connector as in claim 1 wherein each conductor receiving region is a generally C-shaped slot extending through the elongated U-shaped frame having a longitudinal axis aligned substantially parallel to the U-shaped frame.

4. A grounding connector as in claim 1 wherein the upper and lower arms of the frame have opposed surfaces for engaging the flange of the structural member; and wherein at least one of the opposed surfaces has an elongated protrusion such that when the U-shaped frame is caused to clasp the flange of the structural member, the protrusion provides a slight interference between the width of the U-shaped defined by a distance between the upper arm and the lower arm thereof frame and a thickness of the flange of the structural member.

5. A grounding connector as in claim 4 wherein both of the opposed surfaces have an elongated protrusion thereon; and wherein the elongated protrusions are substantially coplanar.

6. A grounding connector as in claim 5 wherein the protrusions are aligned substantially parallel to the U-shaped frame.

7. A grounding connector as in claim 1 wherein the conductor receiving region on one of the sides of the U-shaped frame is sized differently than the conductor receiving region on the other side of the U-shaped frame.

8. A grounding connector as in claim 1 wherein the upper and lower arms of the frame have opposed surfaces for engaging the flange of the structural member; and wherein at least one of the opposed surfaces has an elongated protrusion such that when the U-shaped frame is caused to clasp the flange of the structural member, the protrusion provides a slight interference between the width of the U-shaped frame and the thickness of the flange of the structural member.

9. A grounding connector as in claim 8 wherein both of the opposed surfaces have an elongated protrusion thereon; and wherein the elongated protrusions are substantially coplanar.

10. A grounding connector as in claim 9 wherein the protrusions are aligned substantially parallel to the U-shaped frame.

11. A grounding connector as in claim 9 wherein the protrusions are aligned substantially transverse of the U-shaped frame.

12. A grounding connector as in claim 1 wherein each conductor receiving region is a slot extending through the U-shared frame having a longitudinal axis aligned substantially parallel to the U-shaped frame.

13. A grounding connector as in claim 12 wherein the conductor receiving slot on one side of the U-shaped frame is sized to receive a conductor of a first size; and wherein the conductor receiving slot on the other side of the U-shaped frame is sized to receive a conductor of a different size.

14. A grounding connector as in claim 13 wherein the upper arm extends to a front face and has a continuously extending opening enabling communication between the front face and the conductor receiving slot, the opening sized to exclude entry into the conductor receiving slot of the conductor intended to be received therein; and wherein the lower arm extends to a front face and has a continuously extending opening enabling communication between the front face and the conductor receiving slot, the opening sized to exclude entry into the conductor receiving slot of the conductor intended to be received therein.

15. A grounding connector as in claim 14 wherein the upper arm includes opposed first and second lip members generally encompassing the conductor receiving slot, the first and second lip members being mutually configured such that when the opposite sides of the U-shaped frame are deformed to clasp the flange of the structural member, the second lip member is rolled into the conductor receiving slot beneath the first lip member and into firm engagement with the conductor received in the conductor receiving slot and the first lip member is rolled onto and into firm engagement with the second lip member; and wherein the lower arm includes opposed third and fourth lip members generally encompassing the conductor receiving slot, the first and second lip members being mutually configured such that when the opposite sides of the U-shaped frame are deformed to clasp the flange of the structural member, the fourth lip member is rolled into the conductor receiving slot beneath the third lip and into firm engagement with the conductor received in the conductor receiving slot, and the third lip member is rolled onto and into firm engagement with the fourth lip member.

16. A grounding connector as in claim 12 wherein each slot has a generally C-shaped cross-section.

* * * * *